US006549175B1

(12) United States Patent
Cencich et al.

(10) Patent No.: US 6,549,175 B1
(45) Date of Patent: Apr. 15, 2003

(54) SIMULTANEOUS MODE MATCHING FEEDLINE

(75) Inventors: Tom Cencich, Littleton, CO (US); Julie A. Huffman, Highlands Ranch, CO (US); Douglas Walcher, Englewood, CO (US)

(73) Assignee: Lockhead Martin Corporation, Bethesda, MD (US)

( * ) Notice: Subject to any disclaimer, the term of this patent is extended or adjusted under 35 U.S.C. 154(b) by 0 days.

(21) Appl. No.: 09/826,970

(22) Filed: Apr. 4, 2001

(51) Int. Cl.[7] ..... H01Q 9/38

(52) U.S. Cl. ..... 343/830; 343/700 MS; 343/863

(58) Field of Search ..... 343/830, 700 MS, 343/797, 745, 747, 820, 821, 822, 795, 863; H01Q 9/38

(56) References Cited

U.S. PATENT DOCUMENTS

| | | | | |
|---|---|---|---|---|
| 4,143,380 A | | 3/1979 | Kyle | 343/895 |
| 4,283,685 A | * | 8/1981 | MacMaster et al. | 330/286 |
| 4,396,921 A | | 8/1983 | O'Hara, et al. | 343/895 |
| 4,849,761 A | | 7/1989 | Thomas | 342/153 |
| 4,862,120 A | * | 8/1989 | Ruxton et al. | 333/34 |
| 5,280,297 A | * | 1/1994 | Profera, Jr. | 343/754 |
| 5,677,699 A | * | 10/1997 | Strickland | 343/895 |
| 6,229,327 B1 | * | 5/2001 | Boll et al. | 324/762 |

OTHER PUBLICATIONS

Appendix J "Design and Analysis of an Orthogonal Mode Transformer" *Four–Arm Spiral Antennas* by Robert G. Corzine and Joseph A. Moski, Artech House, Norwood, MA, 1990 (7 Pages).

* cited by examiner

*Primary Examiner*—Hoanganh Le
(74) *Attorney, Agent, or Firm*—Marsh Fischmann & Breyfogle LLP

(57) ABSTRACT

The present invention provides a matched mode antenna feedline desiged to achieve simultaneous modal impedance matching with a multiple mode N-fold symmetric or N-fold polygonal antenna such as, for example, spiral antennas, sinuous antennas, modulated arm width (MAW) spiral antennas, log periodic dipole (LPDA), monopole (LPMA) arrays, and an N-fold polygonal antenna. In one embodiment, the matched mode antenna feedline (10) includes a plurality of transmission lines (20) arranged in a circular cluster around a central axis (12). Each transmission line (20) extends from an input end (22) thereof connectable with a device such as a beamformer to an output end (24) thereof connectable with an antenna feedpoint. A transition section (30) is provided between the input and output ends (22, 24) of each transmission line (20) wherein the transmission lines (20) are smoothly transitioned from a decoupled state proximal to the input ends (22) thereof to a coupled state proximal to the output ends (24) thereof.

35 Claims, 15 Drawing Sheets

SIMULTANEOUS MODE MATCHING FEEDLINE

FIELD OF THE INVENTION

The present invention relates generally to antenna feedlines, and more pa cularly to antenna feedlines for simultaneous modal impedance matching of a multiple mooe. N-fold symmetric or N-fold polygonal antenna.

BACKGROUND OF THE INVENTION

Conventional feedline technology employs standard transmission line components such as coaxial cables to feed each arm of a multiple-arm antenna. If the transmission lines are isolated from one another (i.e. decoupled), as is typical with conventional antenna feedlines, simultaneous matching of multiple modes cannot be achieved since the coaxial cables remain at a fixed characteristic impedance for all modes. Thus, the feedline and the antenna can only be ideally matched in one of the operating modes. As a result of this limitation, conventional feedline technology is typically designed to have an impedance equal to the average of the antenna operating modal impedances which results in a mismatch loss for each mode and a corresponding power loss in the antenna system.

SUMMARY OF THE INVENTION

Accordingly, the present invention provides an antenna feedline for use in feeding signals to or from an antenna feedpoint of a multiple-arm antenna that achieves improved operating efficiencies. Improved operating efficiencies are achieved because the antenna feedline of the present invention is capable of matching the impedance at the connection port(s) of a device connected to the antenna by the feedline such as, for example, a beamformer, an amplifier, a mixer, or an upconverter/downconverter, as well as simultaneously matching all operating modal impedances of the antenna at the antenna feedpoint, within acceptable tolerances. The matched mode antenna feedline of the present invention achieves this by smoothly transitioning its separate transmission lines (e.g., coaxial cables, microstrips, striplines) from a decoupled state at input ends thereof connectable to the device to a highly coupled state at output ends thereof connectable to the antenna feedpoint. The high coupling at the ends of the multi-transmission line connected to the antenna feedpoint results in modal dependent impedances very similar to the modal input impedances of the highly coupled antenna arms at the antenna feedpoint. It will be appreciated, that although the terms "input end" and "output end" are used herein, the "input end" may be outputting a signal to the device that is received at the "output end" from the antenna or receiving a signal from the device to be output at the "output end" to the antenna depending upon whether the antenna is being used to transmit or receive signals.

According to one aspect of the present invention, a simultaneously matched mode antenna feedline includes a plurality of coaxial cable transmission lines. Each coaxial cable extends between an input end thereof and an output end. The coaxial cables are decoupled from one another proximal to the input ends thereof and coupled with one another proximal to the output ends thereof. In this regard, the matched mode antenna feedline also includes a transition section comprising a section of each said coaxial cable between the input and output ends. In the transition section, the outer conductor of each coaxial cable (and also, if desired, the dielectric layer separating the outer conductor from the inner conductor of the coaxial cable) is removed from the coaxial cable in a tapered manner proceeding from proximal to the input end of the cable towards the output end of the cable to smoothly transition the coaxial cables from a decoupled state proximal to the input ends of the cables to a coupled state proximal to the output ends of the cables. The transition section may be configured to provide for a specified rate of increase in coupling between the coaxial cables proceeding from the input ends toward the output ends of the coaxial cables. In order to provide for a smooth transition with little reflection, the transition section preferably has an electrical length equal to or exceeding one quarter of the wavelength of a lowest frequency signal to be fed via the coaxial cables to or from the antenna feedpoint. Shorter transition sections can be used, however, degraded performance in the form of higher mismatch losses at the lower operating frequencies may occur.

The coaxial cable transmission lines may be arranged in a circular cluster. In this regard, it is desirable to keep the diameter of the circular cluster electrically small (e.g., less than about one-tenth of the wavelength of the highest operating frequency) in order to reduce feedline radiation and minimize interaction with the radiating antenna. To further isolate the coaxial cables from radiation radiating from the antenna elements, the transition section may be disposed within an external shield. However, the shield must be located far enough from the feedline to prevent substantial coupling between the shield and the conductors which would interfere with the simultaneous mode matching capability of the feedline.

In the transition section, the outer conductor (and dielectric layer, if desired) of each coaxial cable transmission line may be removed in a linear tapered manner. In this regard, the outer conductor (and dielectric layer) of each coaxial cable may, for example, be cut along a plane intersecting the coaxial cable at an acute angle measured from the input end of the coaxial cable transmission line. The portion of the outer conductor (and dielectric layer) on the side of the plane facing the output end of the coaxial cable transmission line is removed from the inner conductor. The outer conductor (and dielectric layer) of each coaxial cable transmission line may also be removed in a non-linear tapered manner. In this regard, the outer conductor (and dielectric layer) may, for example, be cut along the intersection of a parabolic surface with such coaxial cable and removed from the inner conductor on the side of the parabolic surface facing the output end of the coaxial cable transmission line. It will be appreciated that the outer conductor (and dielectric layer) may be removed in many other different linear and non-linear tapered manners.

According to another aspect of the present invention, a simultaneously matched mode antenna feedline includes a tapered common member and a plurality of coaxial cables. The tapered common member may be comprised of an electrically conductive material such as, for example, aluminum, copper, brass, gold, silver, or alloys thereof. Each coaxial cable extends between an input end thereof and an output end thereof. The input ends of the coaxial cable are decoupled from one another and the output ends of the coaxial cables are coupled with one another. Between the input ends and the output ends, there is a transition section where the coaxial cables are arranged in a circular cluster around the tapered common member and are smoothly transitioned from being decoupled proximal to the input ends thereof to being coupled with one another proximal to the output ends thereof. In this regard, the transition section is provided by removing the outer conductor (and, if desired, also the dielectric layer) of each coaxial cable in a tapered manner proceeding from proximal to the input ends thereof towards the output ends thereof. It will be appreciated that the tapered common member and the transition section of the coaxial cables may be cooperatively tapered in a linear or a non-linear manner.

According to a further aspect of the present invention, a simultaneously matched mode antenna feedline includes a substrate configured in a shape at least partially surrounding a volume. In this regard, the substrate may, for example, be configured in one of a cylindrical shape, a conical shape, and a multiple sided tubular shape (e.g., a square tube, a rectangular tube, a hexagonal tube, or many other polygonal tubular shapes). A plurality of electrically conductive strips are provided on the substrate (e.g., microstrips or striplines). Each strip is oriented longitudinally on the substrate and extends substantially parallel with the other strips between an input end of the strip and an output end of the strip. A single ground plane (microstrips) or two ground planes (striplines) are also provided on the substrate. The ground plane(s) is configured to transition the strips from a decoupled state proximal to the input ends of the strips to a coupled state proximal to the output ends of the strips. In this regard, the ground plane(s) may comprise a plurality of tapered areas, with each tapered area being associated with a separate one of the strips. Each tapered area is wider proximal to the input end of its associated strip and is tapered to a point proximal to the output end of its associated strip. The tapered areas may be tapered in a linear or a non-linear manner proceeding from proximal to the input ends of the strips towards the output ends of the strips. The tapered areas may be or may not be interconnected with one another proximal to the input ends of the strips.

According to one more aspect of the present invention, a simultaneously matched mode antenna feedline includes a substrate configured in a shape at least partially surrounding a volume. In this regard, the substrate may, for example, be configured in one of a cylindrical shape, a conical shape, and a multiple sided tubular shape (e.g., a square tube, a rectangular tube, a hexagonal tube, or many other polygonal tubular shapes). A plurality of electrically conductive strips are provided on the substrate (e.g., microstrips or striplines). Each strip is oriented longitudinally on the substrate and extends substantially parallel with the other strips between an input end of the strip and an output end of the strip. One or more grounding members is disposed within the volume. The grounding member(s) is shaped to transition the strips from a decoupled state proximal to the input ends of the strips to a coupled state proximal to the output ends of the strips. In this regard, the grounding member may be conically shaped.

According to yet another aspect of the present invention, a simultaneously matched mode antenna feedline includes a plurality of coaxial cables. Each coaxial cable extends between an input end thereof and an output end. The coaxial cables are decoupled from one another proximal to the input ends thereof and coupled with one another proximal to the output ends thereof. In this regard, the matched mode antenna feedline also includes a transition section comprising a conically shaped electrically conductive member and a section of each coaxial cable between the input and output ends thereof wherein the outer conductor (and also the dielectric layer, if desired) of each coaxial cable is removed therefrom. The conically shaped electrically conductive member may be linearly or non-linearly tapered from its base to its apex. The sections of the coaxial cables from which the outer conductor (and dielectric layer) have been removed are inserted in a corresponding plurality of holes extending from the base of the conically shaped electrically conductive member therethrough parallel with a central axis of the conically shaped electrically conductive member. In this regard, the holes may be arranged in a circular cluster or a polygonal cluster around the central axis of the conically shaped electrically conductive member.

In summary, a simultaneous mode matching feedline in accordance with the present invention includes four general characteristics. The first characteristic of the feedline is a smooth transition between isolated transmission lines at the input end and coupled lines (multi-transmission line) at the output end. The second characteristic is the plurality of transmission line configurations that the feedline can be comprised of including coaxial, stripline, microstrip, coplanar strips, and coplanar waveguides and which can be configured in cylindrical, conical or multiple-sided tubular shapes (e.g., rectangular, hexagonal). The third characteristic of the simultaneous mode matching feedline is that the transition section can be tapered in a plurality of linear and non-linear configurations to achieve a smooth transition from isolated transmission lines at the input end to a coupled feedline at the output end. The fourth characteristic of the feedline is that it can be comprised of any number of isolated transmission lines at the input end which transition to the same number of coupled lines at the output end, that number being equal to the number of coupled antenna elements that the lines are connected to at the feedpoint.

These and other aspects and advantages of the present invention will be apparent upon review of the following Detailed Description when taken in conjunction with the accompanying figures.

DESCRIPTION OF THE DRAWINGS

For a more complete understanding of the present invention and further advantages thereof, reference is now made to the following Detailed Description, taken in conjunction with the drawings, in which.

DETAILED DESCRIPTION

Figure 1A:
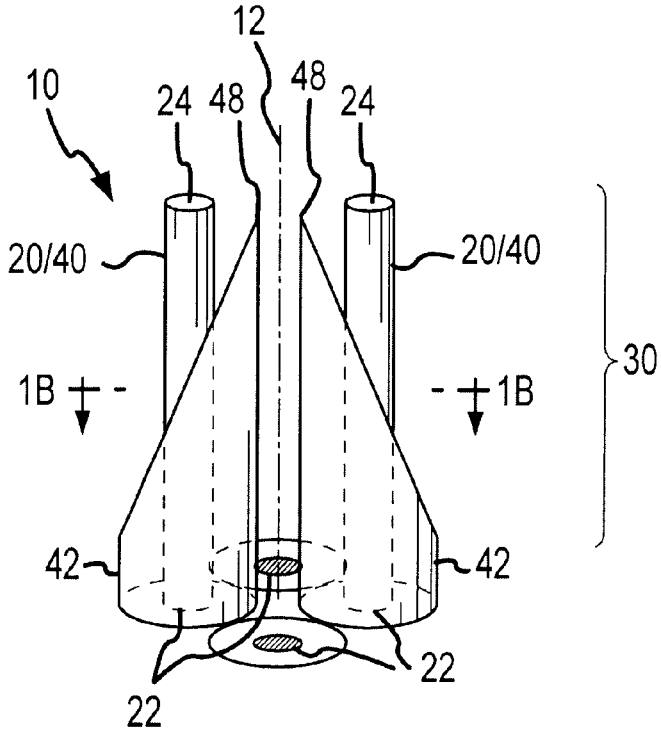
FIGS. 1A–B show perspective and cross-sectional views, respectively, of one embodiment of a matched mode antenna feedline in accordance with the present invention wherein a transition section of the feedline is linearly tapered (only two of four transmission lines of the feedline are shown in their entirety in FIG. 1A for purposes of clarity)
Figure 1B:
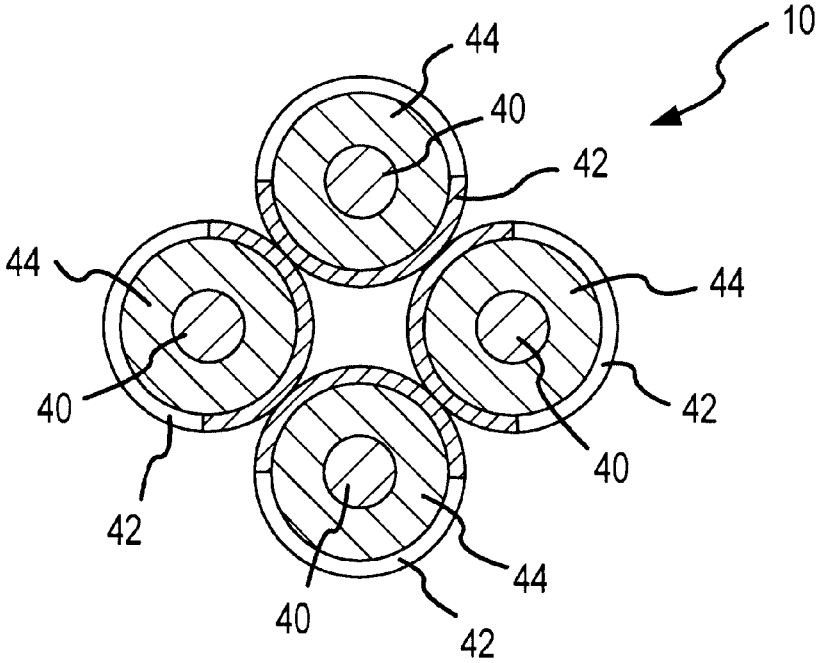

FIGS. 1A–B show one embodiment of a matched mode antenna feedline 10 in accordance with the present invention. The matched mode antenna feedline 10 is designed to achieve simultaneous modal impedance matching with a multiple mode N-fold symmetric or N-fold polygonal antenna. The class of antennas for which the matched mode antenna feedline 10 is intended to feed include multi-element (i.e. antennas having N elements, N>1) rotational symmetry such as, for example, spiral antennas, sinuous antennas, modulated arm width (MAW) spiral antennas, log periodic dipole (LPDA) and monopole (LPMA) arrays.

The matched mode antenna feedline 10 includes four transmission lines 20 (some of which are not shown in their entirety for purposes of illustration) for feeding an antenna having four elements (e.g., a four-arm spiral antenna). However, it should be ppreciated that the matched mode antenna feedline 10 may have fewer or more transmission lines 20 depending upon the number of antenna elements in the antenna to be fed with the feedline 10.

The four transmission lines 20 are arranged in a circular cluster around a central axis 12. Each transmission line extends from an input end 22 thereof connectable with a beamformer port to an output end 24 thereof connectable with a feedpoint of an element of the antenna. It will be appreciated that the input ends 22 of the transmission lines may be connectable with devices other than a beamformer such as, for example, an amplifier, a mixer, or an upconverter/downconverter. Between the input and output ends 22, 24, each transmission line 20 includes a transition section 30 wherein the transmission lines 20 are smoothly transitioned from a decoupled state proximal to the input ends 22 thereof to a coupled state proximal to the output ends 24 thereof. In this regard, the transition section 30 is configured to provide for a rate of increase in coupling between the transmission lines 20 to achieve the characteristic modal impedance of a multi-transmission line at the output ends 24 of the transmission lines 20.

Figure 2A:
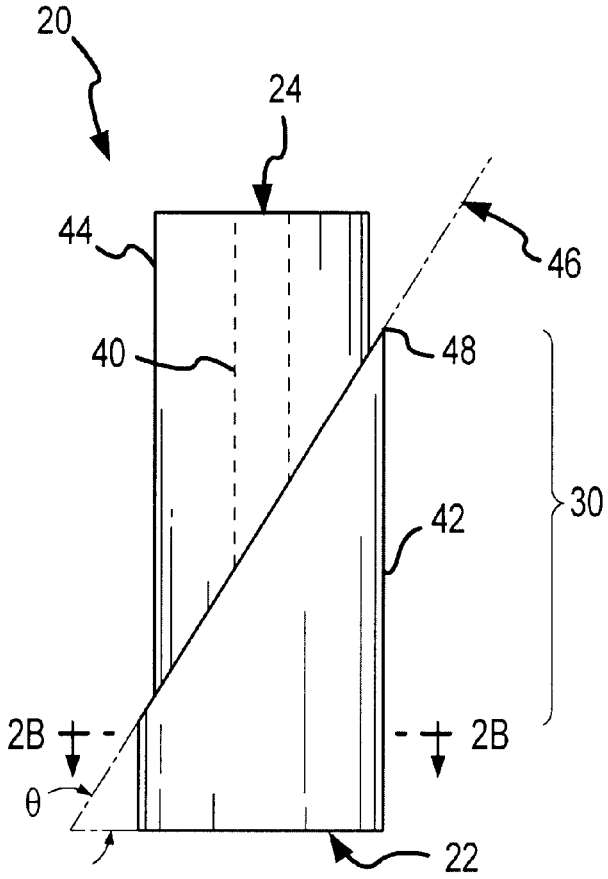
FIGS. 2A–C show side, cross-sectional and perspective views, respectively, of one of the transmission lines of the matched mode feedline of FIG. 1.
Figure 2B:
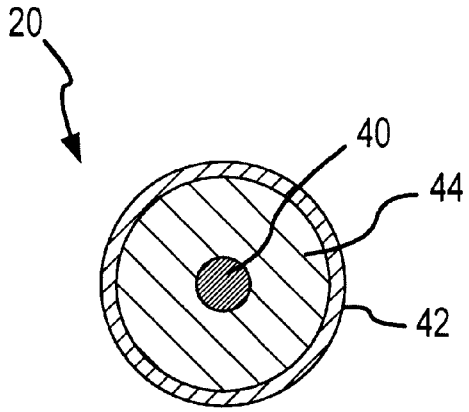
Figure 2C:
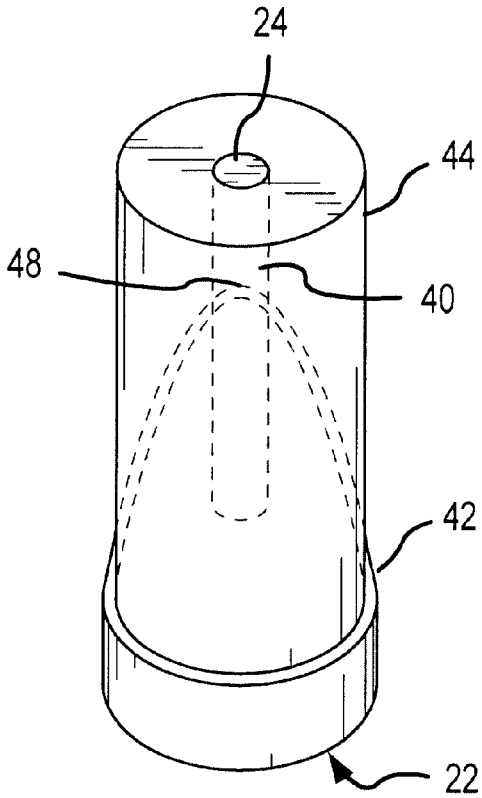

Referring now to FIGS. 2A–C there are shown side, cross-sectional and perspective views, respectively, of one of the transmission lines 20 of the matched mode feedline of FIGS. 1A–B. The transmission line 20 comprises a coaxial cable having a cylindrical inner conductor 40, a cylindrical outer conductor 42 and a dielectric layer 44 between the inner and outer conductors 40, 42. The transition section 30 is provided by removing the outer conductor 42 (and also, if desired, the dielectric layer 44) in a linearly tapered fashion proceeding from proximal to the input end 22 of the transmission line 20 towards the output end 24 of the transmission line 20. In this regard, the inner conductor 40 is completely shielded by the outer conductor 42 proximal to the input end 22 of the transmission line 20. The outer conductor 42 is cut along a plane 46 intersecting the transmission line 20 at an acute angle θ measured from the input end 22 of the transmission line 20. The outer conductor 42 is removed from the inner conductor 40 on the side of the plane 46 facing the output end 24 of the transmission line 20 to uncover the inner conductor 40 and the dielectric layer 44 beyond a tip 48 of the outer conductor 42 proximal to the output end 24 of the transmission line 20. As is shown in FIGS. 1A–B, the four transmission lines 20 are arranged such that the tips 48 of their outer conductors 42 are inside the circular cluster adjacent to the central axis 12 of the circular cluster. With the transmission lines 20 thus configured and arranged, the transmission lines 20 are isolated (i.e., decoupled) from one another proximal to their input ends 22 where the inner conductors 40 are shielded and coupled with one another proximal to their output ends 24 where the inner conductors 40 and dielectric layer 44 are exposed, with the degree of coupling increasing proceeding from the input ends 22 towards the output ends 24.

In order to reduce feedline radiation and keep interaction with the radiating antenna below acceptable levels for most applications, the diameter of the cluster of transmission lines 20 may be electrically small. In this regard, the electrical diameter of the cluster may be less than one-tenth (0.1) of the wavelength of the highest frequency signal to be fed via the matched mode feedline 10 to or from the antenna. It will be appreciated that the diameter of the cluster of transmission lines 20 will also depend upon the spacing of the antenna arms at the antenna feedpoint.

Figure 3A:
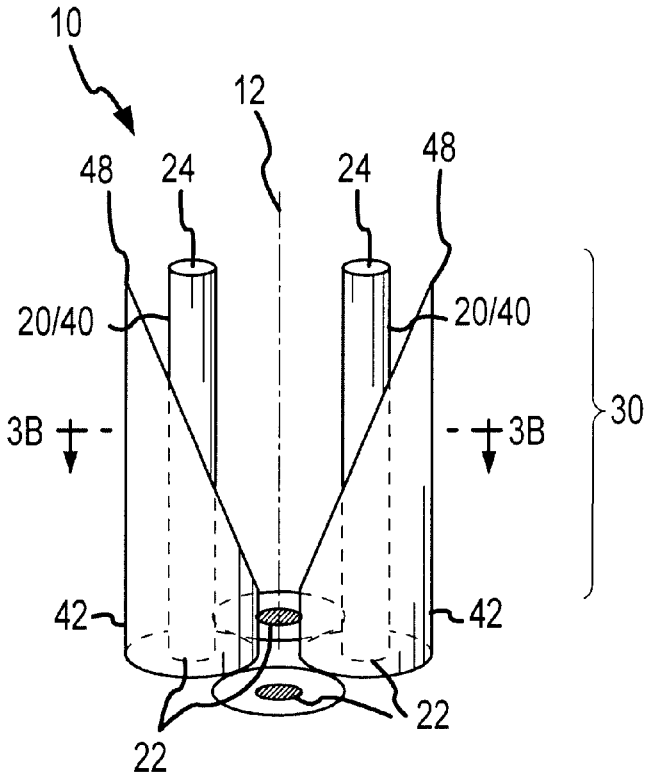
FIGS. 3A–B show perspective and cross-sectional views, respectively, of an embodiment of a matched mode antenna feedline similar to the embodiment shown in FIGS. 1A–B wherein the transmission lines are rotated 180° about their axes (only two of four transmission lines of the feedline are shown in their entirety in FIG. 3A for purposes of clarity)
Figure 3B:
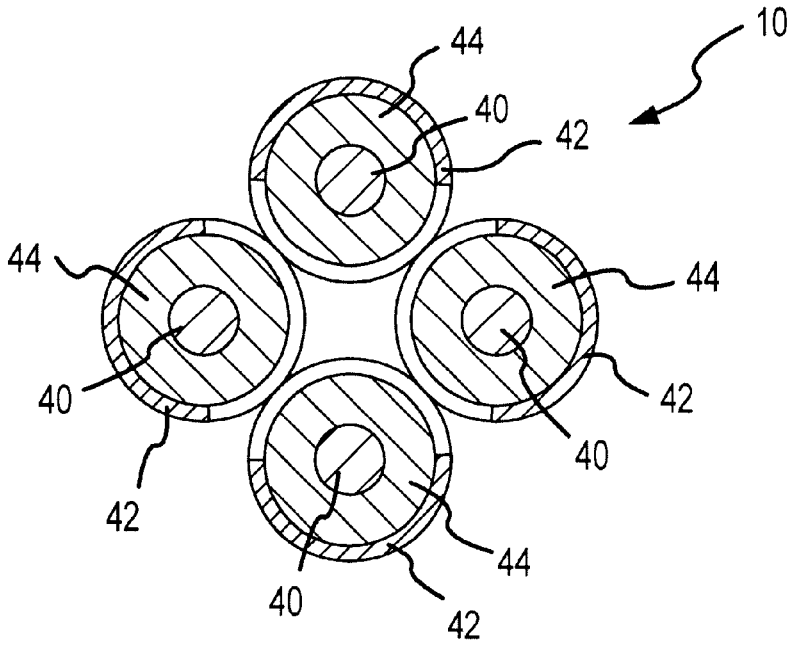

Referring now to FIGS. 3A–B, there is shown a matched mode antenna feedline 10 similar to that shown in FIGS. 1 A–B, but having an alternative arrangement of the coaxial cable transmission lines 20. In FIGS. 3A–B, the four transmission lines 20 are rotated 180° about their axes so that the tips 48 of their outer conductors 42 are on the outer circumference of the circular cluster.

Figure 4A:
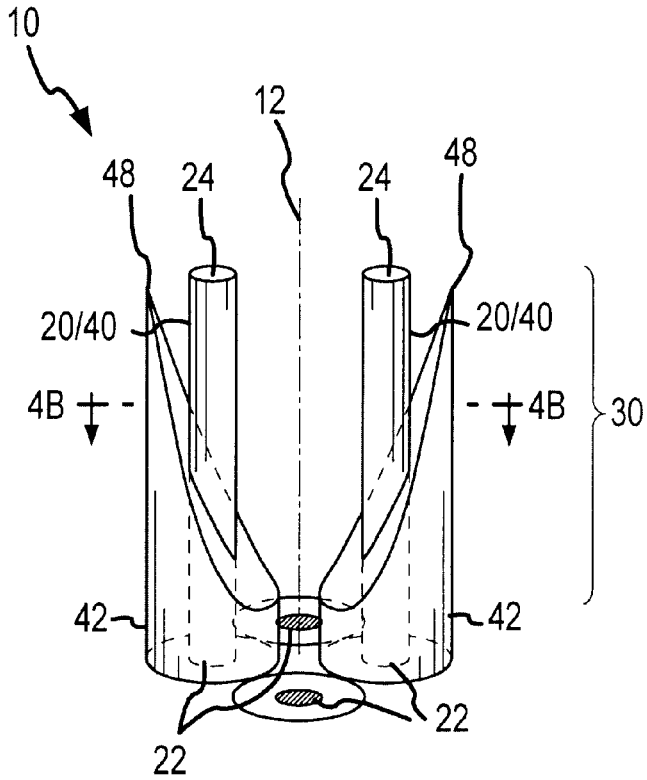
FIGS. 4A–B show perspective and cross-sectional views, respectively, of an embodiment of a matched mode antenna feedline in accordance with the present invention wherein a transition section of the feedline is non-linearly tapered (only two of four transmission lines of the feedline are shown in their entirety in FIG. 4A for purposes of clarity)
Figure 4B:
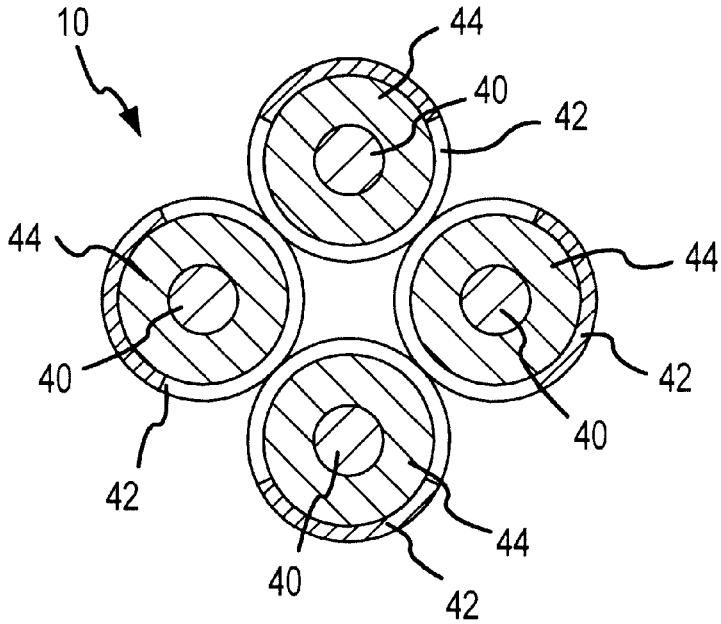
Figure 5A:
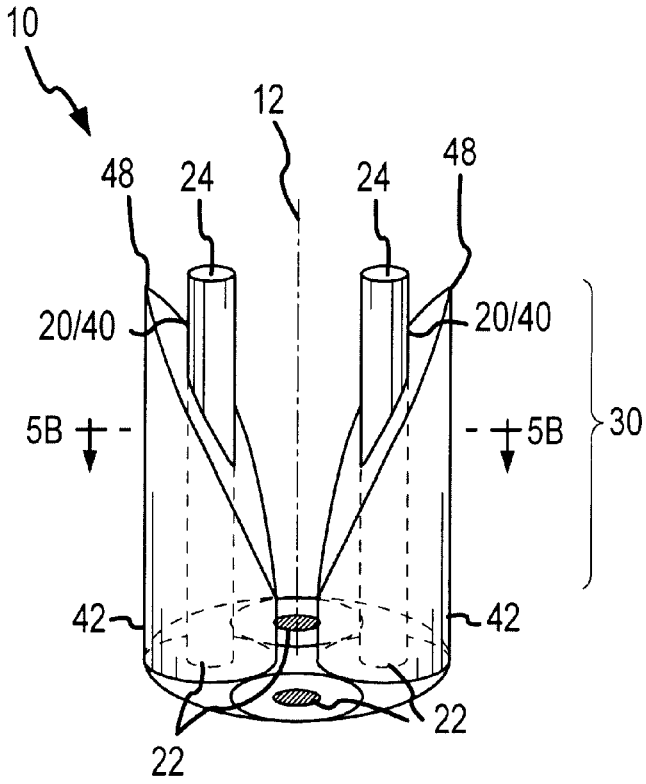
FIGS. 5A–B show perspective and cross-sectional views, respectively, of another embodiment of a matched mode antenna feedline in accordance with the present invention wherein a transition section of the feedline is non-linearly tapered (only two of four transmission lines of the feedline are shown in their entirety in FIG. 5A for purposes of clarity)
Figure 5B:
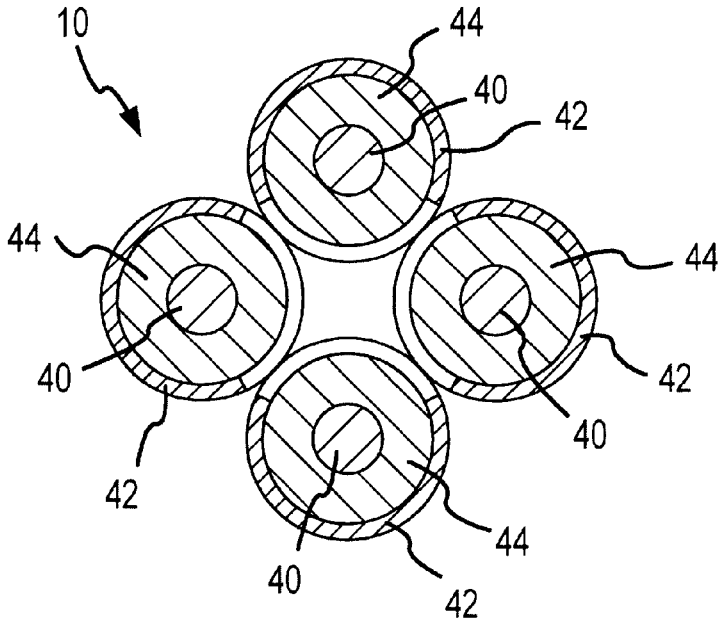

Referring now to FIGS. 4A–B, there is shown an embodiment of the matched mode antenna feedline 10 where the coaxial cable transmission lines 20 are tapered in a non-linear manner in the transition section 30 as opposed to the linear taper of the coaxial cable transmission lines 20 in the embodiments shown in FIGS. 1 A–B or FIGS. 3A–B. In this regard, the non-linear taper of the transition section 30 may be provided by cutting the outer conductor 42 (and also, if desired, the dielectric layer 44) along the intersection of a parabolic surface with the transmission line 20. The outer conductor 42 is removed on the side of the parabolic surface facing the output end 24 of the transmission line 20 to completely uncover the inner conductor 40 and the dielectric layer 44 beyond a tip 48 of the outer conductor 42 proximal to the output end 24 of the transmission line 20. As is0 shown in FIGS. 4A–B, the four transmission lines 20 are arranged such that their tips 48 are on the outside of the cluster. With the transmission lines 20 thus configured and arranged, the transmission lines 20 are isolated (i.e., decoupled) from one another proximal to their input ends 22 where the inner conductors 40 are shielded and coupled with one another proximal to their output ends 24 where the inner conductors 40 and dielectric layers 44 are exposed, with the degree of coupling increasing proceeding from the input ends 22 towards the output ends 24. It will be appreciated that, in addition to the linear and non-linear tapers illustrated in FIGS. 1–4, many other linear and non-linear tapered configurations are possible. One example is shown in FIGS. 5A–B. It will also be appreciated that the outer conductors 42 (and dielectric layers 44, if desired) can be removed such that the linear or non-linear tapers are located inside the cluster of inner conductors 40 by rotating each transmission line 20 180° about its axis.

Figure 6A:
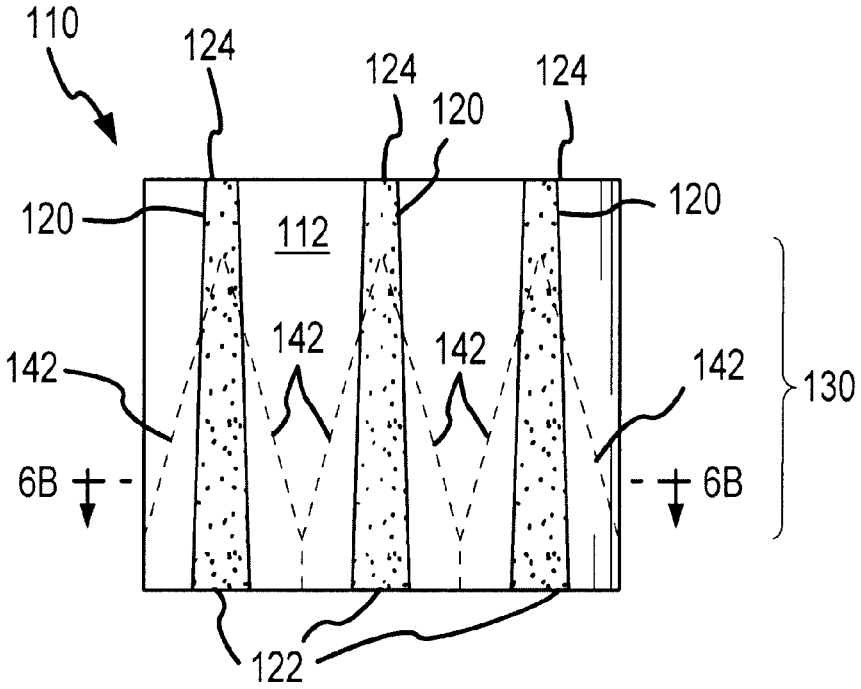
FIGS. 6A–B show side and cross-sectional views, respectively, of an embodiment of a matched mode antenna feedline in accordance with the present invention where the transmission lines comprise electrically conductive strips provided on a cylindrical substrate with individual tapered ground plane areas provided on an inner surface of the substrate.
Figure 6B:
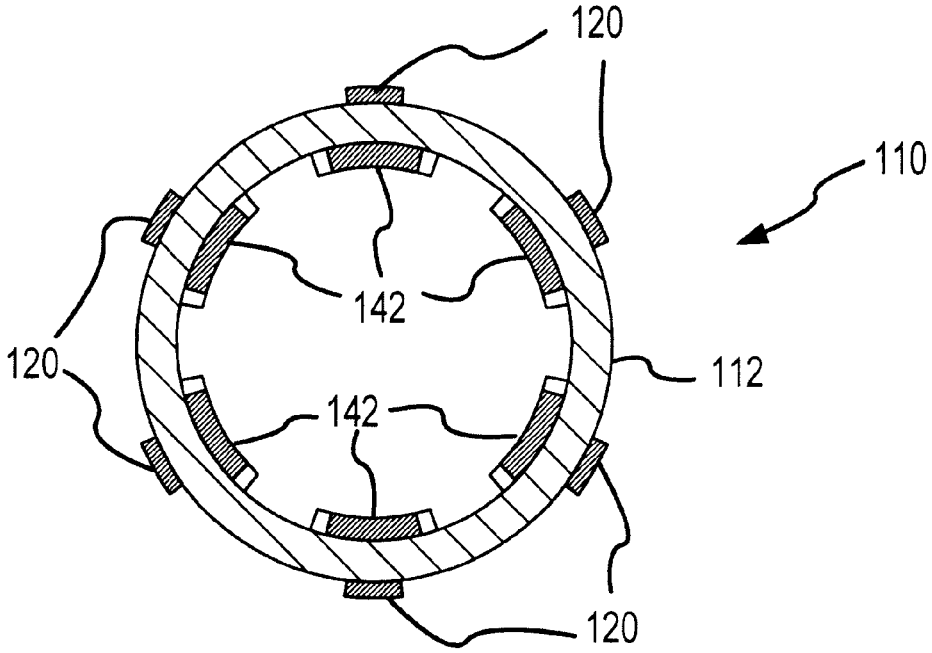
Figure 7A:
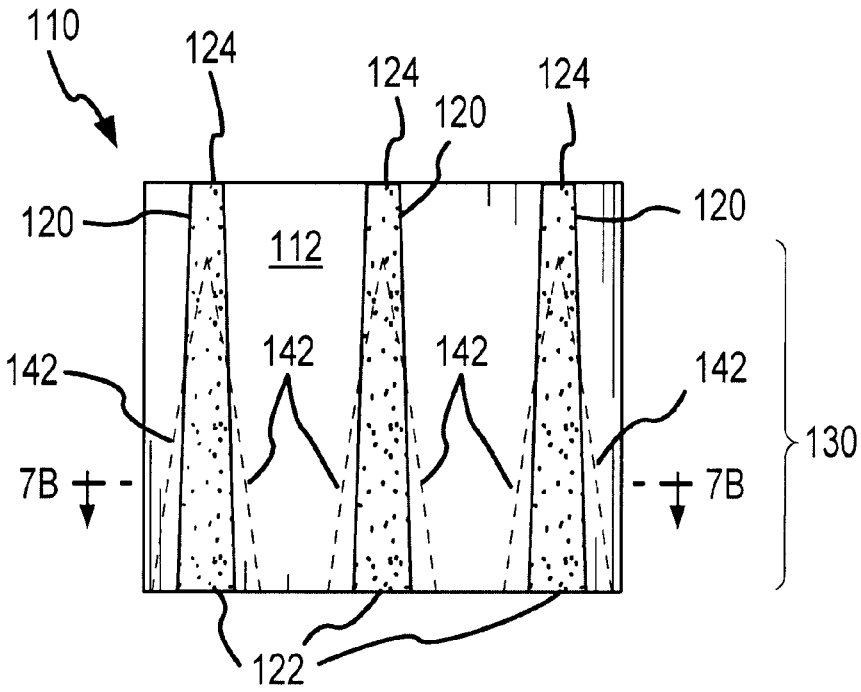
FIGS. 7A–B show side and cross-sectional views, respectively, of an embodiment of a matched mode antenna feedline similar to the embodimerit shown in FIGS. 6A–B wherein the individual tapered ground plane areas are not interconnected with one another.
Figure 7B:
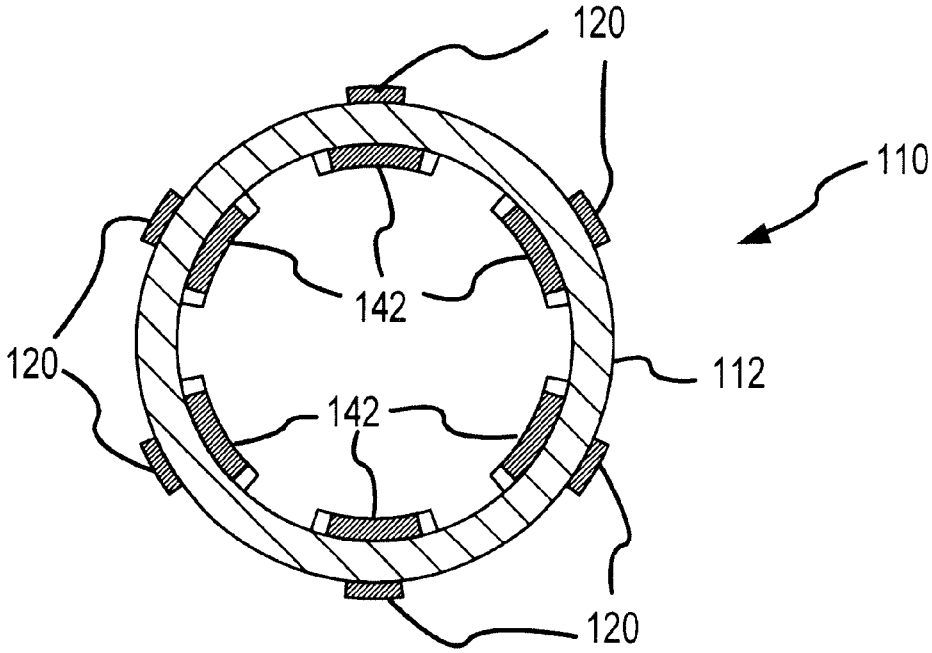

Referring now to FIGS. 6A–B, there is shown an embodiment of a matched mode antenna feedline 110 in accordance with the present invention wherein the transmission lines 120 comprise electrically conductive strips (e.g., microstrip's or striplines) provided on a cylindrical substrate 112 rather than coaxial cables arranged in a circular cluster. A transition section 130 between decoupled input ends 122 of the transmission lines 120 and coupled output ends 124 of the transmission lines 120 is provided by a ground plane 142 formed on the inner surface of the cylindrical substrate 112. The ground plane 142 includes a plurality of tapered areas. Each tapered area of the ground plane 142 underlies a separate one of the transmission lines 120 and decreases in width proceeding toward the output ends 124 until there is no longer any ground plane 142 underlying such transmission line 120 proximal to the output ends 124 thereof. Proximal to the input ends 122 of the transmission lines 120 where the tapered areas of the ground plane 142 are widest, the electrically conductive strip transmission lines 120 have substantially greater coupling with the ground plane 142 than with one another, as long as the ground plane 142 is spaced closer to the strip transmission lines 120 than the.s-trip transmission lines 120 are to one another. Proximal to the output ends 124 of the transmission lines 120 where the ground plane 142 has been tapered to points, the transmission lines 120 will have substantially greater coupling with one another than with the ground plane 142. Proximal to the input ends 122 of the transmission lines 120, the tapered areas of the ground plane 142 may be connected with one another so that the ground plane 142 is continuous around the inner surface of the cylindrical substrate 112. It will be appreciated that the ground plane 142 does not have to be continuous around the inner surface of the cylindrical substrate 112 proximal to the input ends. 122 of the transmission lines 120. An example of a matched mode antenna feedline 110 similar to the embodiment shown in FIGS. 6A–B where the ground plane 142 is not continuous around the inner surface of the of the cylindrical substrate is shown in FIGS. 7A–B.

Figure 8A:
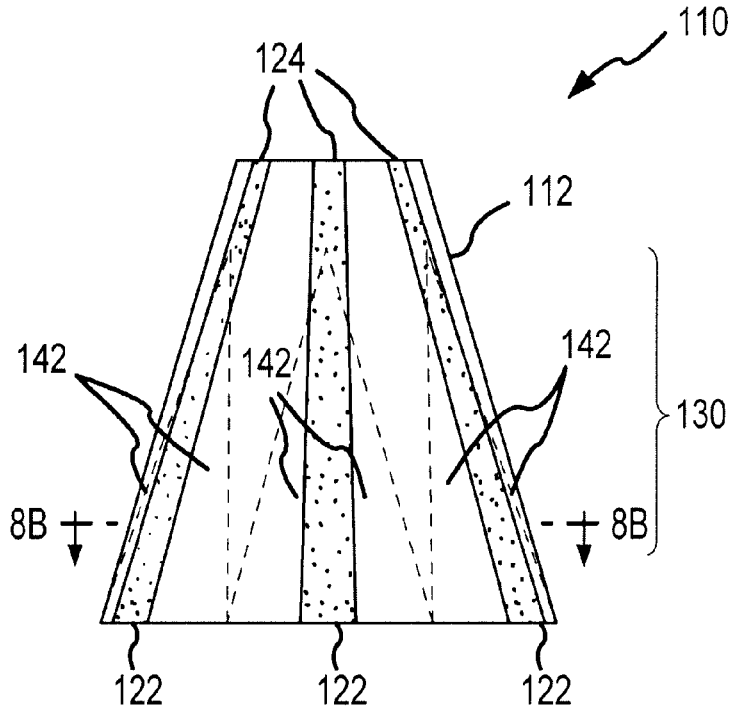
FIGS. 8A–B show side and cross-sectional views, respectively, of an embodiment of a matched mode antenna feedline in accordance with the present invention where the transmission lines comprise electrically conductive strips provided on a conical substrate with individual tapered ground plane areas provided on an inner surface of the substrate.
Figure 8B:
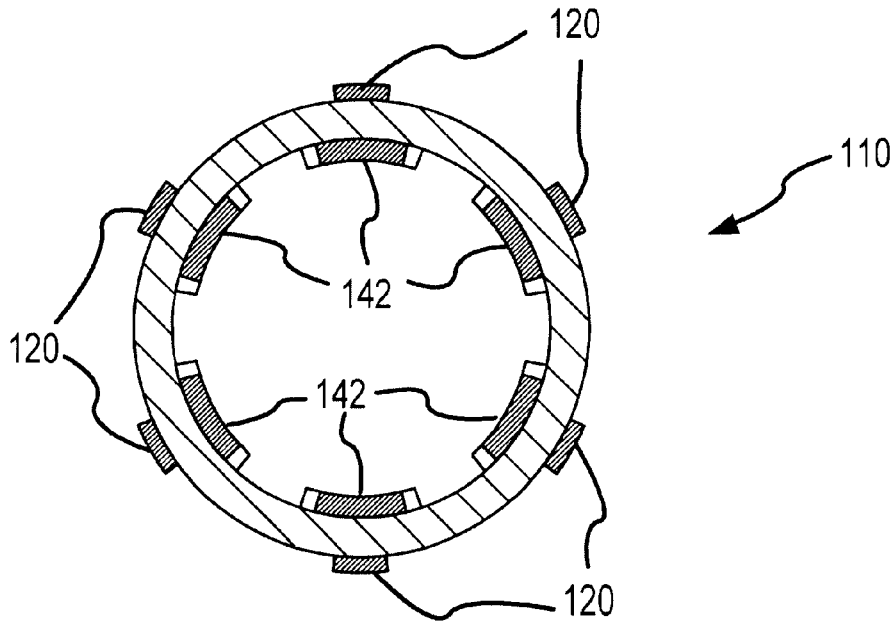
Figure 9A:
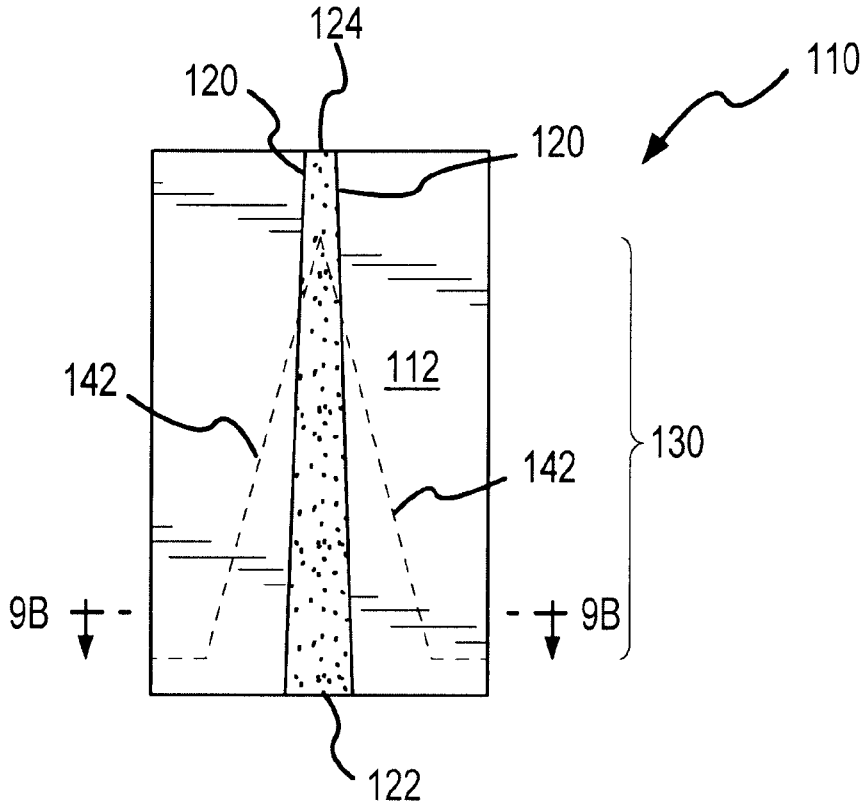
FIGS. 9A–B show side and cross-sectional views, respectively, of an embodiment of a matched mode antenna feedline in accordance with the present invention where the transmission lines comprise electrically conductive strips provided on a square tubular substrate with individual tapered ground plane areas provided on an inner surface of the substrate.
Figure 9B:
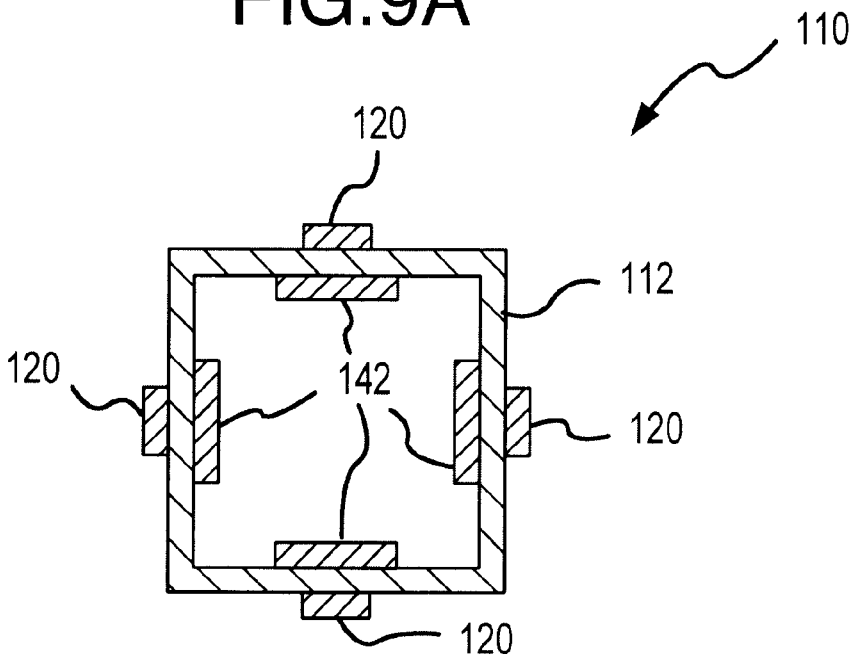
Figure 10A:
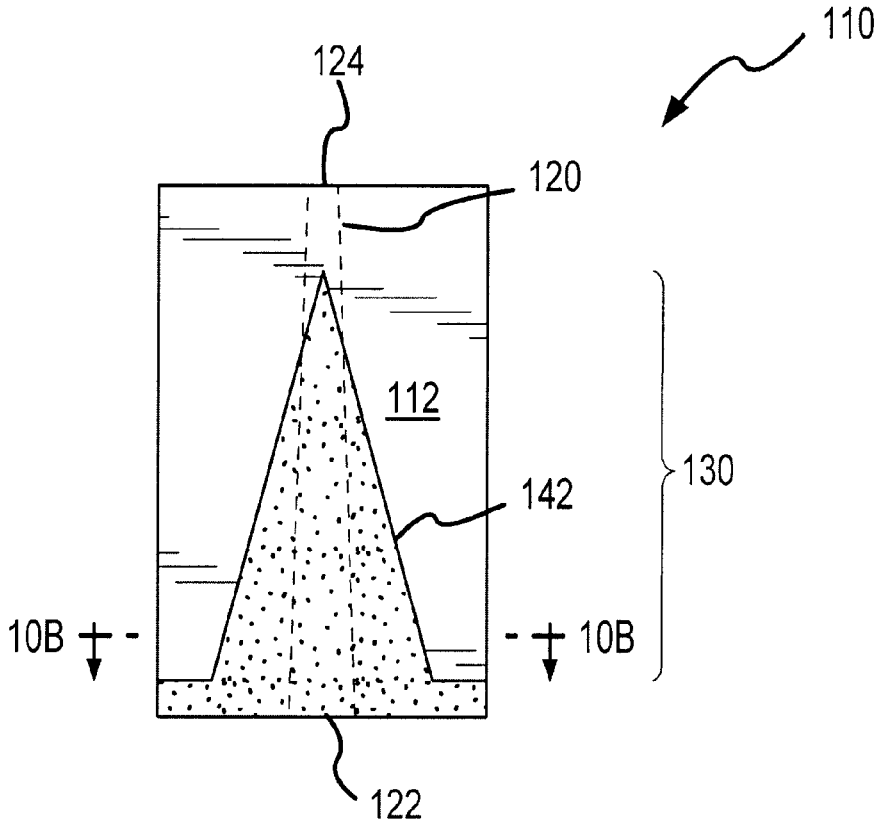
FIGS. 10A–B show side and cross-sectional views, respectively, of an embodiment of a matched mode antenna feedline similar to the embodiment shown in FIGS. 9A–B wherein the individual tapered ground plane areas' are provided on an outer surface of the substrate.
Figure 10B:
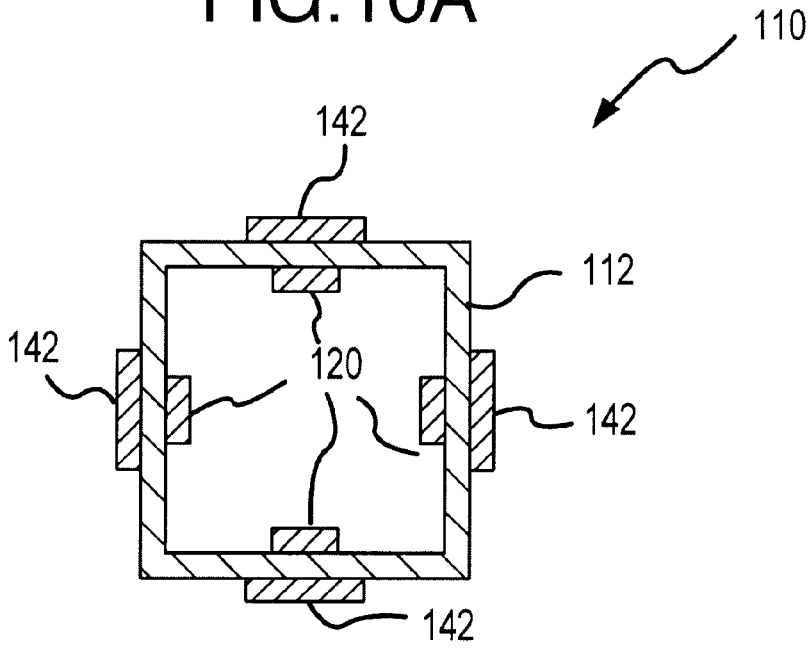
Figure 11A:
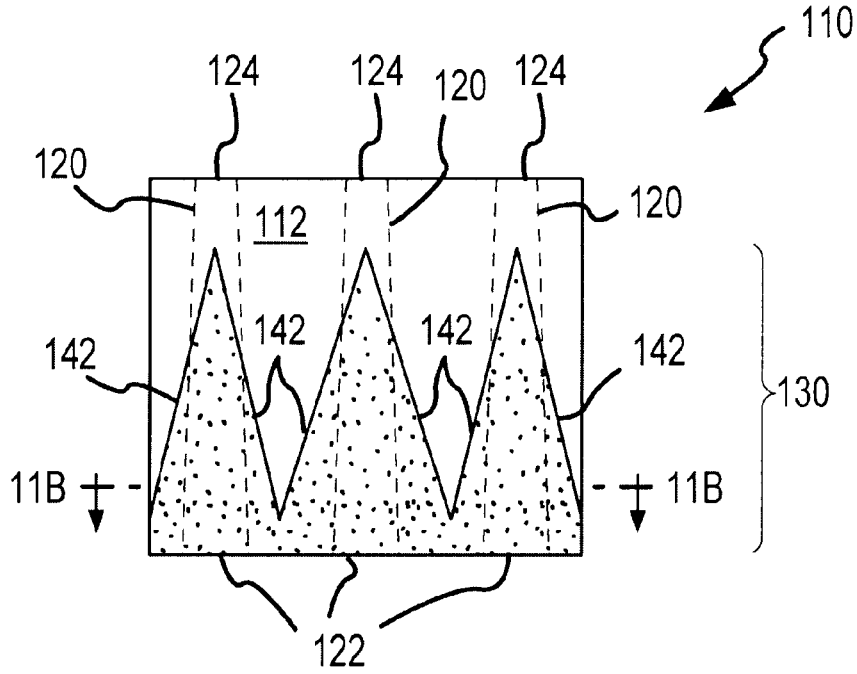
FIGS. 11A–B show side and cross-sectional views, respectively, of an embodiment of a matched mode antenna feedline in accordance with the present invention where the transmission lines comprise electrically conductive strips provided on a cylindrical substrate with individual tapered ground plane areas provided on both an inner surface and an outer surface of the substrate.
Figure 11B:
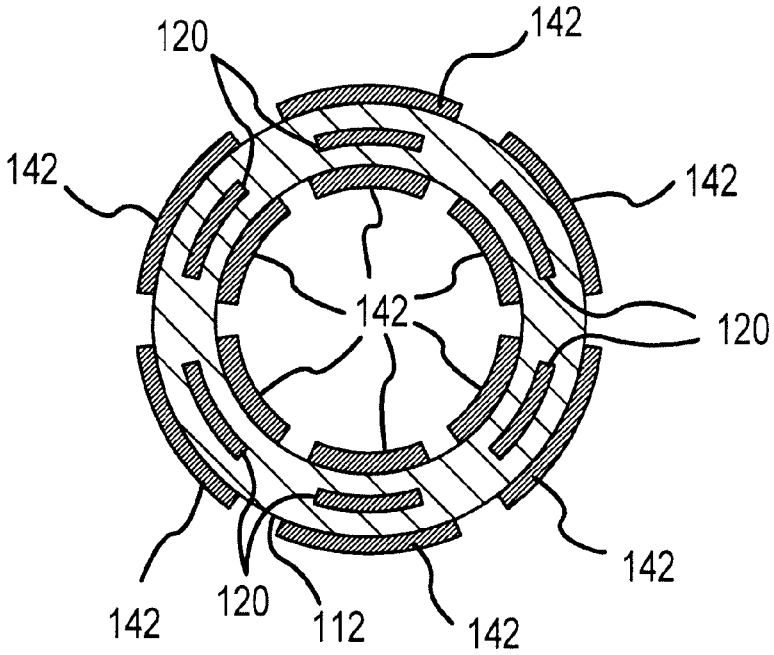

As is shown in FIGS. 6A–B, the tapered areas of the ground plane 142 may be configured to have a linear taper towards the output ends 124 of the transmission lines 120 (e.g., triangular shaped tapered areas). It will be appreciated that the tapered areas of the ground plane 142 may also be configured in a non-linear tapered manner (e.g., parabolic). Further, it should be appreciated that although a cylindrical substrate 112 such as has been illustrated may provide the best geometry for modal matching with the antenna inputs of a rotationally symmetric antenna, the substrate 112 may be configured in other manners. For example, if desired and with some added manufacturing complexity, the substrate 112 may be conically configured as is shown in FIGS. 8A–B. Another example is shown in FIGS. 9A–B, where the substrate 112 is an N-sided polygonal tube (e.g., a cross-sectionally square tube), with N equaling the number of transmission lines 120 (e.g., four). Also, as is illustrated in FIGS. 10A–B, the transmission lines 120 may be formed on the interior surface of the substrate 112 and the ground plane 142 may be provided on the exterior surface of the. substrate 112. Further, in a stripline configuration, as is shown in FIGS. 11A–B, there are two ground planes 142 formed on the interior and exterior surfaces of the substrate 112 with the transmission lines 120 positioned between the interior and exterior ground planes 142.

Figure 12A:
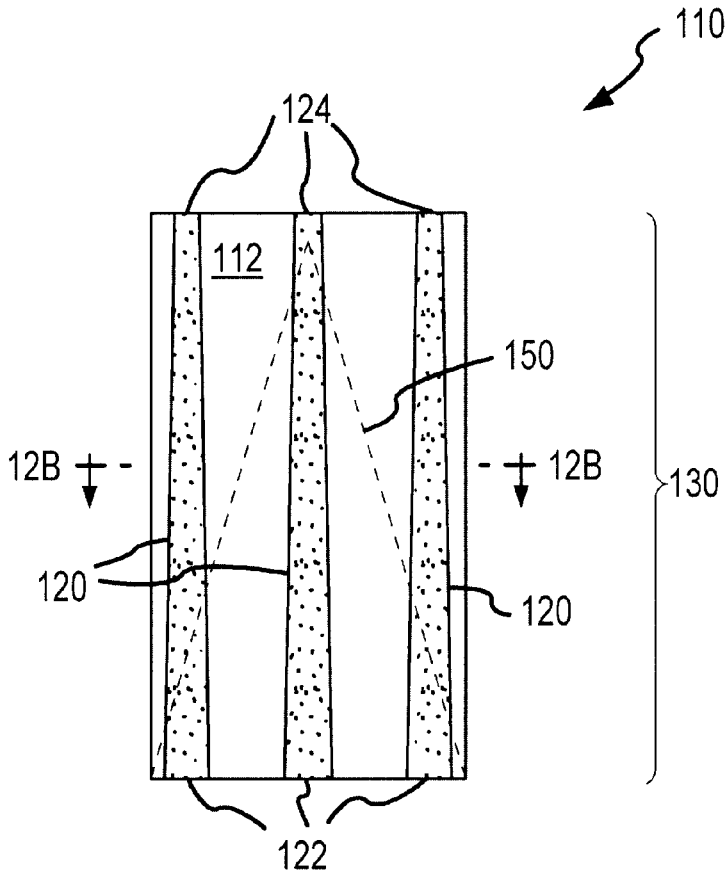
FIGS. 12A–B show side and cross-sectional views, respectively, of an embodiment of a matched mode antenna feedline in accordance with the present invention wherein the transmission lines comprise electrically conductive strips provided on a cylindrical substrate with a single tapered grounding member disposed within the cylindrical substrate.
Figure 12B:
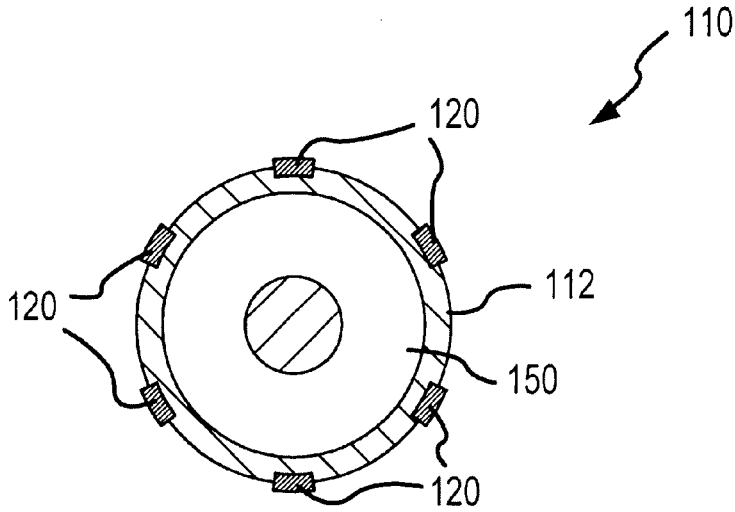

Referring now to FIGS. 12A–B, there is shown another embodiment of a matched mode antenna feedline 110 wherein the transmission lines 120 comprise electrically conductive strips on the outer surface of a cylindrical substrate 112 similar to the embodiment shown in FIGS. 6A–B. Rather than having a ground plane with tapered portions formed on the inner surface of the cylindrical substrate 112, the transition section 130 is provided by a conical ground plane member 150 disposed within the hollow volume surrounded by the cylindrical substrate 112. The conical ground plane member 150 is comprised of an electrically conductive material such as, for example, aluminum. The base of the conical ground plane member 150 is proximal to the input ends 122 of the transmission lines 120 in order to provide for isolation of the input ends 122 from one another. The apex of the conical ground plane member 150 is proximal to the output ends 124 of the transmission lines 120 so that the output ends 124 are coupled with one another. As is shown in FIGS. 12A–B, the conical ground plane member 150 may have a linear taper from its base to its apex. It will be appreciated that the conical ground plane member 150 may also have a non-linear taper from its base to its apex.

Figure 13A:
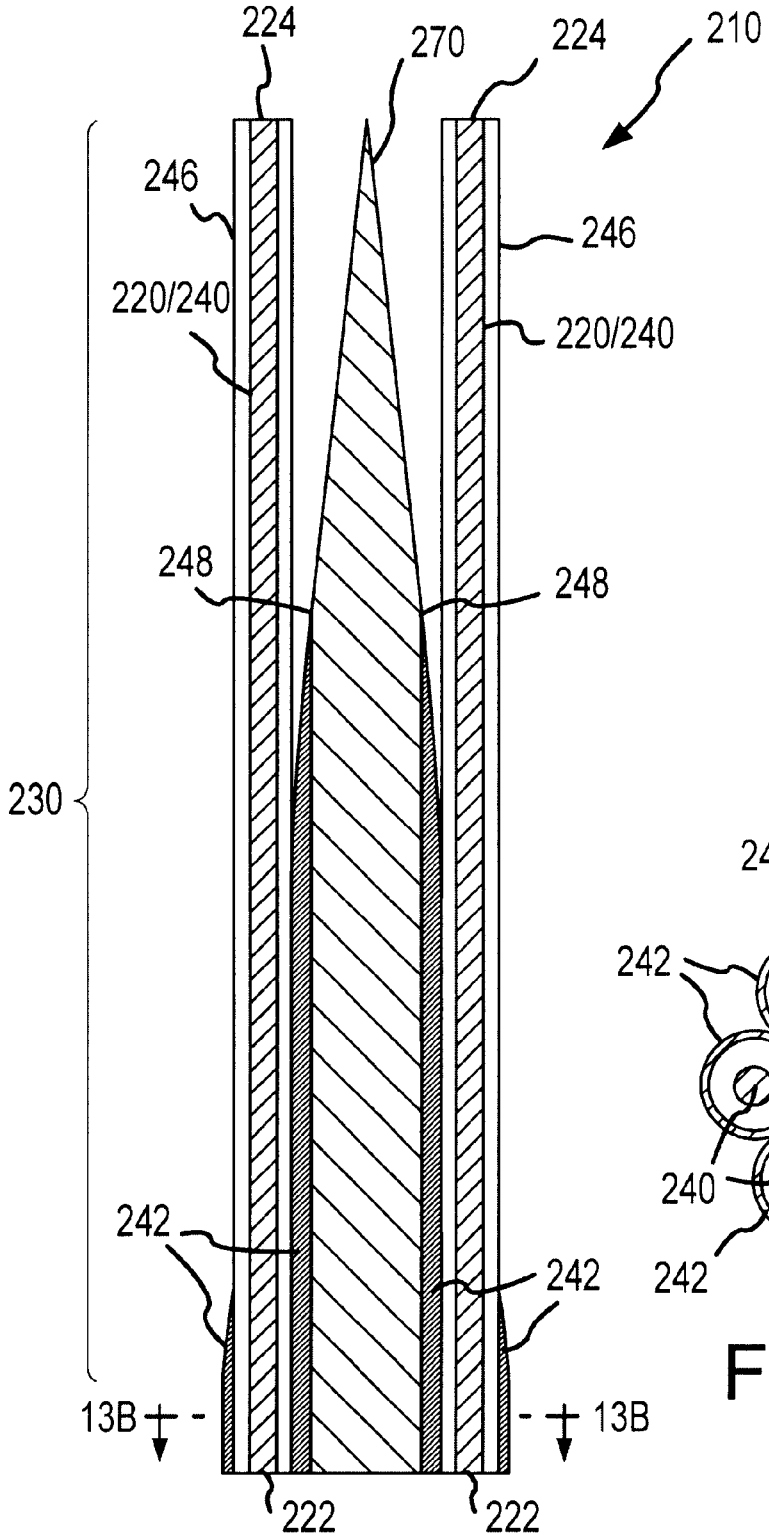
FIGS. 13A–B show side cross-sectional and bottom views, respectively, of an embodiment of a matched mode antenna feedline in accordance with the present invention having a tapered common conductor and six tapered transmission lines clustered around the common conductor.
Figure 13B:
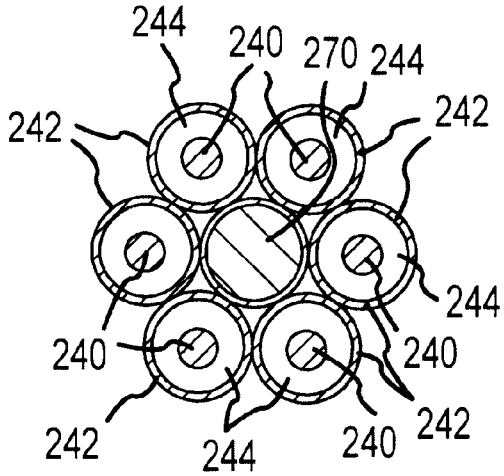

Referring now to FIGS. 13A–B, there are shown side cross-sectional and bottom views, respectively, of a matched mode antenna feedline 210 having a common conductor 270 around which multiple transmission lines 220 are clustered. The matched mode feedline 210 includes six transmission lines 220 that are connectable at input ends 222 thereof to the ports of a beamformer or another device for transmission of signals to and from an antenna. Each transmission line 220 is connectable at a output end 224 thereof to an antenna feedpoint.

The transmission lines 220 comprise coaxial cables which are arranged in a circular cluster about the common conductor 270. The common conductor 270 maintains a desired separation between the coaxial cable transmission lines 220. A transition section 230 between the decoupled input ends 222 and coupled output ends 224 of the transmission lines 220 is provided by removing the outer conductor 242 (and also, if desired, the dielectric layer 244) from each coaxial cable transmission line 220 in a linearly tapered manner as previously described in connection with the embodiment shown in FIGS. 1A–B. In order to continue the increase in the coupling between the transmission lines, the common conductor 270 tapers to a point proximal to the output ends 224 of the transmission lines 220. In this regard, the tapered common conductor 270 may be machined from a rod of aluminum such that it begins to taper from near where the tips 248 of the removed outer conductor 242 are located. This provides for a continuous and smooth transition towards a coupled state without any sudden discontinuities in the transmission lines 220.

Figure 14A:
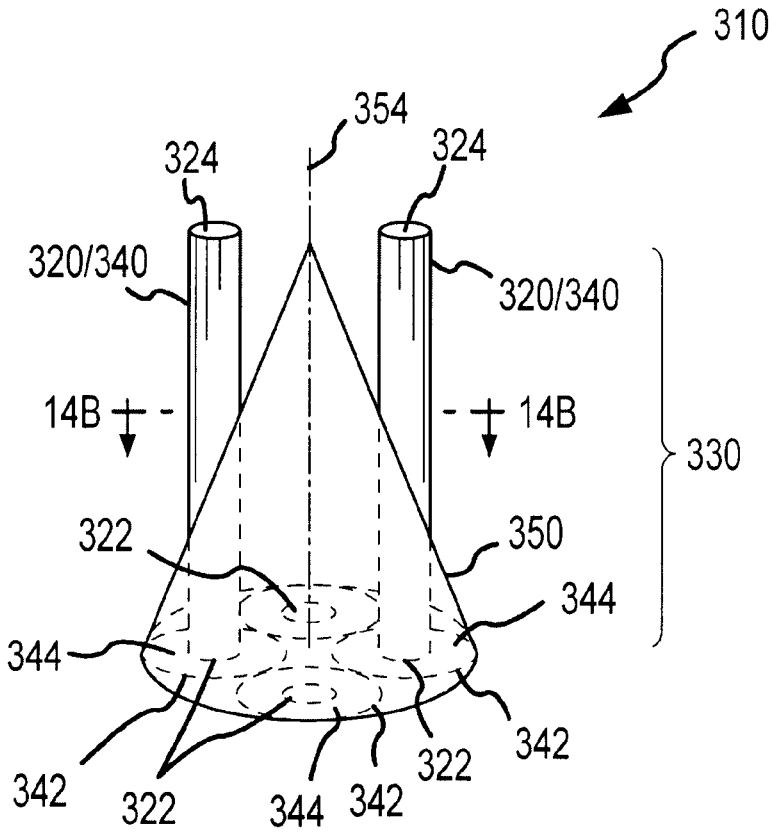
FIGS. 14A–B show perspective and cross-sectional views, respectively, of an embodiment of a matched mode antenna feedline in accordance with the present invention having a conically shaped conductive member with transmission lines extending through holes therein (only two of four transmission lines of the feedline are shown in their entirety in FIG. 14A for purposes of clarity)
Figure 14B:
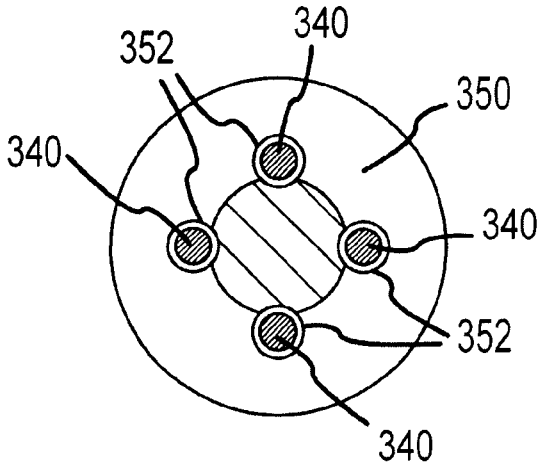

Referring now to FIGS. 14A–B, there is shown a matched mode antenna feedline 310 in accordance with the present invention having a conically shaped conductive member 350 that provides for a smooth transition section 330 between decoupled input and coupled output ends 322, 324 of a plurality of transmission lines 320 (e.g., four transmission lines). In this regard, the conically shaped conductive member 350 may have a linear or a non-linear taper from the circumference of its base to its apex. The conically shaped conductive member 350 includes a plurality of holes 352 (e.g., four holes 352) extending through the conically shaped conductive member 350 substantially parallel with a central axis 354 of the conically shaped conductive member 350. The transmission lines 320 comprise coaxial cables having an inner conductor 340 shielded by an outer conductor 342 and a dielectric layer 344 between the inner and outer conductors 340, 342. The outer conductor 342 (and also the dielectric layer 344, if desired) is removed from each coaxial cable transmission line 320 and each coaxial cable transmission line 320 is inserted through a corresponding hole 352 in the conically shaped conductive member 350. In this regard, the outer conductor 342 (and dielectric layer 344, if desired) may be completely removed from the inner conductor 340 of each coaxial cable transmission line 320 in the transition section 330, or the outer conductor 342 (and dielectric layer 344, if desired) may be removed from the inner conductor 340 in a tapered manner corresponding with the taper of the conically shaped conductive member 350 (i.e. linear or non-linear) similar to the coaxial cable transmission lines 20 shown in FIGS. 1A–5B.

Figure 15A:
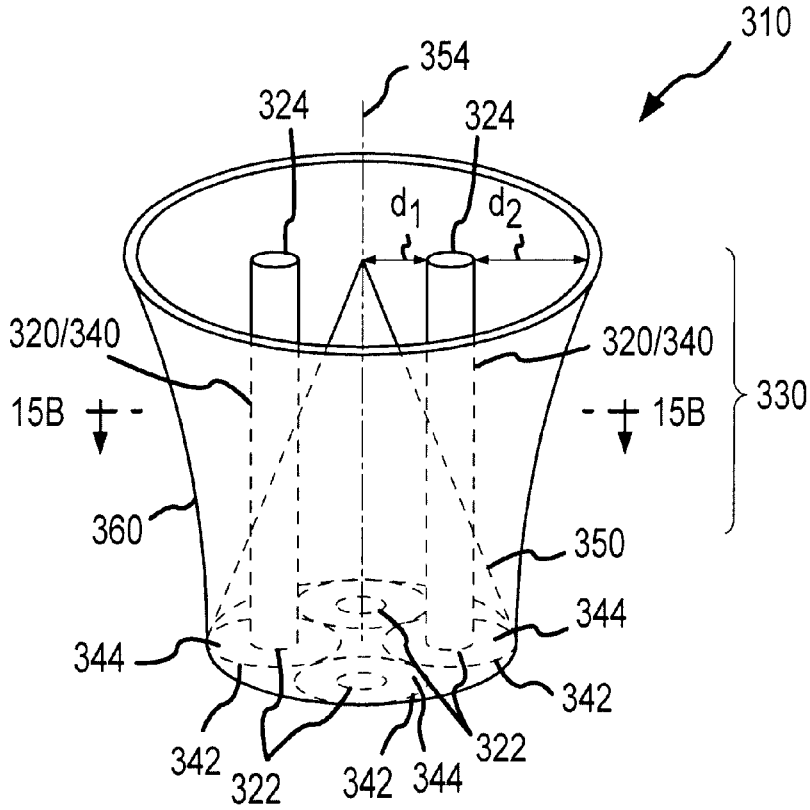
FIGS. 15A–B show perspective and cross-sectional views, respectively, of an embodiment of a matched mode antenna feedline similar to the embodiment shown in FIGS. 14A–B that includes an external shield (only two of four transmission lines of the feedline are shown in their entirety in FIG. 15A for purposes of clarity).
Figure 15B:
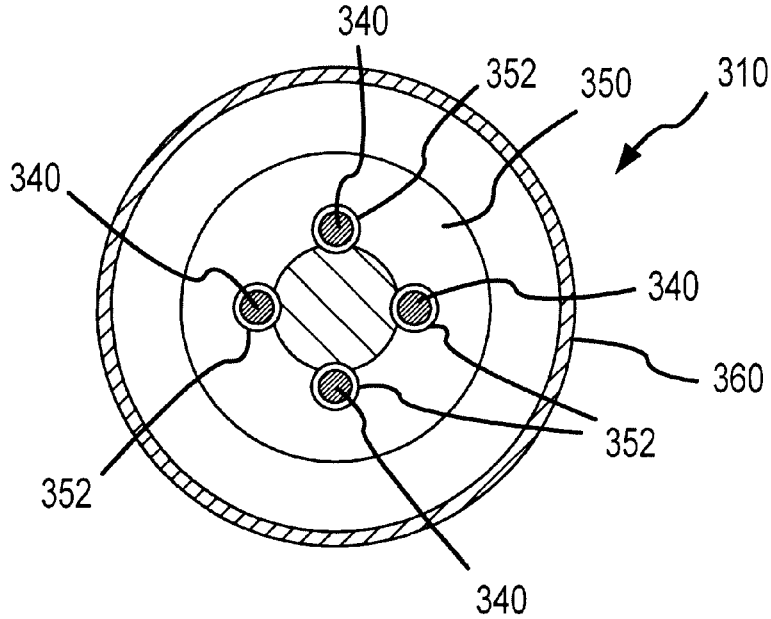

As is shown in FIGS. 15A–B, the matched mode antenna feedline 310 of FIGS. 14A–B may be provided with external shielding 360 surrounding the conically shaped conductive member 350 and coaxial cable transmission lines 320 to further isolate the transmission lines 20 from the radiating antenna. In this regard, the external shielding 360 should be flared away from the uncovered inner conductors 340 of the coaxial cable transmission lines 320 so that at the output ends 324 of the coaxial cable transmission lines 320, the distance dl from the inner conductors 340 to the central axis 354 of the conically shaped conductive member 350 is substantially less than the distance d2 from the uncovered inner conductors 340 to the external shielding 360. This ensures that the inner conductors 340 are tightly coupled with one another instead of with the external shielding 360.

Regardless of its configuration, it is desirable that the transition sections 30, 130, 230, 330 of the previously described matched mode antenna feedlines 10, 110, 210, 310 transition the transmission lines 20, 120, 220, 320 from a decoupled state to a coupled state over an electrical length that is approximately as long as one-quarter of the wavelength of the lowest frequency signal that is intended to be fed through the matched mode feedline 10, 110, 210, 310 to an antenna. By way of example, if 3 GHz is the lowest frequency signal for which the matched mode antenna feedline 10, 110, 210, 310 is intended, the transition section 30, 130, 230, 330 should be at least one inch long in air, or approximately 0.71 inches long with a Teflon dielectric. It will be appreciated that the desirable electrical length of the transition section will also be dependent upon other factors such as the impedance of the antenna modes, the impedance of the beamformer or other device, and the impedance taper (e.g., exponential, Chebyshev, Hecken) used to transform the impedance. Furthermore, the impedance characteristics of the matched mode antenna feedlines 10, 110, 210, 310 can be modeled using multi-transmission line theory and will be dependent upon a number of factors, including the number of transmission lines, the diameter or width of the transmission lines, the dielectric constants of the material between the transmission lines, the separation between the transmission lines, and the ground configuration.

While various embodiments of the present invention have been described in detail, further modifications and adaptations of the invention may occur to those skilled in the art. However, it is to be expressly understood that such modifications and adaptations are within the spirit and scope of the present invention.

What is claimed is:

1. A simultaneously matched mode antenna feedline comprising:

a plurality of coaxial cables equal in number to a number of antenna elements to be fed by said feedline, each said coaxial cable extending between an input end thereof and an output end thereof and including an inner conductor shielded proximal to said input end thereof by an outer conductor and a dielectric layer between said inner and outer conductors; and a transition section comprising a section of each said coaxial cable between said input and output ends thereof wherein said outer conductor of each said coaxial cable is removed therefrom in a tapered manner proceeding from proximal to said input end thereof towards said output end thereof with said outer conductor being completely removed prior to said output end, thereby transitioning said coaxial cables from decoupled fixed impedance transmission lines proximal to said input ends thereof to a coupled modal dependent multi-transmission line proximal to said output ends thereof.

2. The simultaneously matched mode antenna feedlihe of claim 1 wherein, in said transition section, said dielectric layer is also removed from each said coaxial cable in a tapered manner proceeding from said input end thereof towards said output end thereof.

3. The simultaneously matched mode antenna feedline of claim 1 wherein said transition section has an electrical length of at least one quarter of a wavelength of a lowest frequency signal to be fed through said matched mode antenna feedline.

4. The simultaneously matched mode antenna feedline of claim 1 wherein, in said transition section, said outer conductor of each said coaxial cable is removed therefrom in a linear tapered manner.

5. The simultaneously matched mode antenna feedline of claim 4 wherein said outer conductor of each said coaxial cable has been cut along an intersection of a plane with said coaxial cable and removed from said inner conductor on a side of said plane facing said output end of said coaxial cable.

6. The simultaneously matched mode antenna feedline of claim 5 wherein said plane intersects said coaxial cable at an acute angle measured from said input end of said transmission line.

7. The simultaneously matched mode antenna feedline of claim 1 wherein, in said transition section, said outer conductor of each said coaxial cable is removed therefrom in a non-linear tapered manner.

8. The simultaneously matched mode antenna feedline of claim 7 wherein said outer conductor of each said coaxial cable has been cut along an intersection of a parabolic surface with said coaxial cable and removed from said inner conductor on a side of said parabolic surface facing said output end of said transmission line.

9. The simultaneously matched mode antenna feedline of claim 1 wherein said coaxial cables are arranged in one of a circular cluster and a polygonal cluster.

10. The simultaneously matched mode antenna feedline of claim 9 wherein said circular cluster has an electrical diameter of less than one-tenth of a wavelength of a highest frequency signal to be fed through said matched mode antenna feedline.

11. A simultaneously matched mode antenna feedline comprising:

a tapered common member;

a plurality of coaxial cables, each said coaxial cable extending between an input end thereof and an output end thereof and including an inner conductor shielded proximal to said input end thereof by an outer conductor and a dielectric layer between said inner and outer by conductors; and a transition section wherein said coaxial cables are arranged in a circular cluster around said tapered common member and wherein said outer conductor of each said coaxial cable is removed therefrom in a tapered manner proceeding from proximal to said input end thereof towards said output end thereof with said outer conductor being completely removed prior to said output end, thereby transitioning said coaxial cables from decoupled fixed impedance transmission lines proximal to said input ends thereof to a coupled modal dependent multi-transmission line proximal to said output ends thereof.

12. The simultaneously matched mode antenna feedline of claim 11 wherein, in said transition section, said dielectric layer is also removed from each said coaxial cable in a tapered manner proceeding from said input end thereof towards said output end thereof.

13. The simultaneously matched mode antenna feedline of claim 11 wherein said transition section has an electrical length of at least one quarter of a wavelength of a lowest frequency signal to be fed through said matched mode antenna feedline.

14. The simultaneously matched mode antenna feedline of claim 11 wherein said tapered common member is linearly tapered, and wherein, in said transition section, said outer conductor of each said coaxial cable is removed therefrom in a linear tapered manner.

15. The simultaneously matched mode antenna feedline of claim 14 wherein said outer conductor of each said coaxial cable has been cut along an intersection of a plane with said coaxial cable and removed from said inner conductor on a side of said plane facing said output end of said coaxial cable.

16. The simultaneously matched mode antenna feedline of claim 15 wherein said plane intersects said coaxial cable at an acute angle measured from said input end of said transmission line.

17. The simultaneously matched mode antenna feedline of claim 11 wherein said tapered common member is comprised of an electrically conductive material.

18. The simultaneously matched mode antenna feedline of claim 17 wherein said electrically conductive material comprises at least one of aluminum, copper, brass, gold, and silver.

19. A simultaneously matched mode antenna feedline comprising:

a substrate configured in a shape at least partially surrounding a volume;

a plurality of electrically conductive strips provided on said substrate, each said strip extending parallel to said other strips between an input end thereof and an output end thereof; and a ground plane provided on said substrate, said ground plane being configured to transition said strips from a decoupled state proximal to said input ends thereof to a coupled state proximal to said output ends thereof.

20. The simultaneously matched mode antenna feedline of claim 19 wherein said substrate is configured in one of a cylindrical shape, a conical shape, and a multiple sided tubular shape.

21. The simultaneously matched mode antenna feedline of claim 19 wherein said ground plane comprises a plurality of tapered areas, each said tapered area being associated with a separate one of said strips and being tapered to a point proximal to said output end of its associated strip.

22. The simultaneously matched mode antenna feedline of claim 21 wherein said tapered areas of said ground plane are tapered in a linear manner proceeding from proximal to said input ends of said strips towards said output ends of said strips.

23. The simultaneously matched mode antenna feedline of claim 21 wherein said tapered areas of said ground plane are tapered in a non-linear manner proceeding from proximal to said input ends of said strips towards said output ends of said strips.

24. The simultaneously matched mode antenna feedline of claim 21 wherein said tapered areas of said ground plane are interconnected with one another proximal to said input ends of said strips.

25. The simultaneously matched mode antenna feedline of claim 21 wherein said ground plane is provided on an interior surface of said substrate and said simultaneously matched mode antenna feedline further comprises:

a second ground plane provided on an exterior surface of said substrate, said second ground plane being configured to transition said strips from a decoupled state proximal to said input ends thereof to a coupled state proximal to said output ends thereof.

26. A simultaneously matched mode antenna feedline comprising:

a substrate configured in a shape at least partially surrounding a volume;

a plurality of electrically conductive strips provided on said substrate, each said strip extending parallel to said other strips between an input end thereof and an output end thereof; and at least one ground member disposed within said volume, said ground member being shaped to transition said strips from a decoupled state proximal to said input ends thereof to a coupled state proximal to said output ends thereof.

27. The simultaneously matched mode antenna feedline of claim 26 wherein said substrate is configured in one of a cylindrical shape, a conical shape, and a multiple sided tubular shape.

28. The simultaneously matched mode antenna feedline of claim 26 wherein said at least one ground member is conically shaped.

29. A simultaneously matched mode antenna feedline comprising:

a conically shaped electrically conductive member having a plurality of holes extending from a base of said conically shaped electrically conductive member therethrough parallel with a central axis of said conically shaped electrically conductive member;

a plurality of coaxial cables, each said coaxial cable extending between an input end thereof and an output end thereof and including an inner conductor shielded proximal to said input end thereof by an outer conductor and a dielectric layer between said inner and outer conductors; and a transition section comprising a section of each said coaxial cable between said input and output ends thereof wherein said outer conductor of each said coaxial cable is removed therefrom, said sections of said plurality of coaxial cables from which said outer conductors are removed being received in said holes in said conically shaped electrically conductive member.

30. The simultaneously matched mode antenna feedline of claim 29 wherein said conically shaped electrically conductive member is linearly tapered from its base to an apex thereof.

31. The simultaneously matched mode antenna feedline of claim 29 wherein said conically shaped electrically conductive member is non-linearly tapered from its base to an apex thereof.

32. The simultaneously matched mode antenna feedline of claim 29 wherein, in said transition section, said dielectric layer is also removed from each said coaxial cable.

33. The simultaneously matched mode antenna feedline of claim 29 wherein said holes are arranged in one of a circular cluster and a polygonal cluster around said central axis of said conically shaped electrically conductive member.

34. The simultaneously matched mode antenna feedline of claim 33 wherein said circular cluster has an electrical diameter of less than one-tenth of a wavelength of a highest frequency signal to be fed through said matched mode antenna feedline.

35. The simultaneously matched mode antenna feedline of claim 29 wherein said transition section has an electrical length of at least one quarter of a wavelength of a lowest frequency signal to be fed through said matched mode antenna feedline.

* * * * *

UNITED STATES PATENT AND TRADEMARK OFFICE

CERTIFICATE OF CORRECTION

PATENT NO. : 6,549,175 B1
DATED : April 15, 2003
INVENTOR(S) : Cencich et al.

It is certified that error appears in the above-identified patent and that said Letters Patent is hereby corrected as shown below:

Title page,
Item [73], Assignee, delete the word "Lockhead", and insert therefor -- Lockheed --.
Item [57], ABSTRACT,
Line 2, delete the word "desiged", and insert therefor -- designed --.

Column 1,
Line 7, delete the words "pa cularly", and insert therefor -- particularly --.
Line 9, delete the word and punctuation mark "mooe.", and insert therefor -- modal --.

Column 5,
Line 10, delete the word "embodimerit", and insert therefor -- embodiment --.

Column 6,
Line 14, delete the word "ppreciated", and insert therefor -- appreciated --.

Column 8,
Lines 5 and 6, delete the words and punctuation mark "the.strip", and insert therefor -- the strip --.

Column 10,
Line 66, delete the word "feedlihe", and insert therefor -- feedline --.

Column 11,
Line 40, delete the word "fecdline", and insert therefor -- feedline --.

Signed and Sealed this

First Day of July, 2003

JAMES E. ROGAN
*Director of the United States Patent and Trademark Office*